US006467195B2

(12) United States Patent
Pierre et al.

(10) Patent No.: US 6,467,195 B2
(45) Date of Patent: Oct. 22, 2002

(54) HIGH BOOT WITH LACE-TIGHTENING DEVICE

(75) Inventors: Eric Pierre, Immeuble I' Annapurna; Jean-Bruno Danezin, Les Vernays; Guy Azam, La Dray-Pugny-Chatenod Chef Lieu, all of (FR)

(73) Assignee: Salomon, S.A., Metz-Tessy (FR)

( * ) Notice: Subject to any disclaimer, the term of this patent is extended or adjusted under 35 U.S.C. 154(b) by 0 days.

(21) Appl. No.: 09/732,890

(22) Filed: Dec. 11, 2000

(65) Prior Publication Data

US 2001/0007178 A1 Jul. 12, 2001

(30) Foreign Application Priority Data

Dec. 28, 1999 (FR) ..... 99 16846

(51) Int. Cl.[7] ..... A43B 5/04
(52) U.S. Cl. ..... 36/50.5; 36/54
(58) Field of Search ..... 36/50.5, 117.1, 36/54

(56) References Cited

U.S. PATENT DOCUMENTS

| | | | | |
|---|---|---|---|---|
| 2,139,858 A | * | 12/1938 | Schwartz et al. | |
| 2,284,814 A | * | 6/1942 | Gookin | |
| 3,108,385 A | * | 10/1963 | Teufel | |
| 3,545,106 A | | 12/1970 | Martin | 36/50 |
| 4,142,307 A | | 3/1979 | Martin | 36/50 |
| 4,281,468 A | * | 8/1981 | Giese et al. | |
| 4,937,952 A | * | 7/1990 | Olivieri | |
| 5,042,177 A | * | 8/1991 | Schoch | |
| 5,477,593 A | | 12/1995 | Leick | 24/712.5 |
| 5,566,474 A | * | 10/1996 | Leick et al. | |
| 5,937,542 A | * | 8/1999 | Bourdeau | |
| 5,966,841 A | * | 10/1999 | Barret | |

FOREIGN PATENT DOCUMENTS

| | | |
|---|---|---|
| DE | 891065 | 9/1953 |
| DE | 1893010 | 5/1964 |
| DE | 9413174 | 11/1994 |
| EP | 0629793 | 12/1994 |
| EP | 0891722 | 1/1999 |
| EP | 0923886 | 6/1999 |
| FR | 1568397 | 5/1969 |
| IT | 1169109 | 5/1987 |

* cited by examiner

*Primary Examiner*—Ted Kavanaugh
(74) *Attorney, Agent, or Firm*—Greenblum & Bernstein, P.L.C.

(57) ABSTRACT

A high boot having, on its bottom part that surrounds the foot, a lace-tightening device whose strands are alternatively crossed by means of returns, from one edge to the other of the upper to be adjusted on the foot. The strands of the lace are directed so as to converge from the instep zone up to the top portion of a tongue provided with a guiding double tunnel, via two semi-flexible sheaths. The tightening device of the boot leaves the flexion fold zone free and can be controlled in tightening from the edge of the top portion of the upper.

21 Claims, 3 Drawing Sheets

HIGH BOOT WITH LACE-TIGHTENING DEVICE

BACKGROUND OF THE INVENTION

1. Field of the Invention

The present invention relates to an article of footwear, such as a high boot, having a lace-tightening device adapted to adjust the front portion thereof on the user's forefoot and instep.

2. Description of Background and Relevant Information

Footwear articles of the aforementioned type, such as the boots described in the patents DE 18 93 010, IT 19700/83, FR 1 568 397, and EP 629 793 have lace-tightening devices that close either in a conventional manner by a knot, or by means of a locking mechanism or a tensioning lever. Furthermore, depending on the possible needs to differentiate tightening, these tightening devices adjust the boot upper simultaneously on the user's foot and lower leg, as is the case in the boots disclosed in patents IT 19700/83 and FR 1 568 397, or solely on the foot, as is the case in the boot disclosed in patent DE 18 93 010 and patent application EP 629 793. In these latter boots, a supplemental tightening device specific to the lower leg is then provided. These various ways of using the lace or cable tightening devices make it possible to adjust the fitting room to the user's foot relatively well. Conversely, they require that a relatively substantial tensile force be exerted on the strands of the lace to obtain an efficient tightening at the instep. Indeed, due to the fact that the strands are alternately crossed, by means of eyelets, in the transverse direction relative to the boot, whereas the pulling action performed on their free ends is directed in the longitudinal direction of the boot, substantial friction occurs on the eyelets, especially on those located at the instep, and which must be overcome to bring the edges of the upper closer together on the foot. Of course, friction also occurs in the area where the strands of the lace are guided and returned in the locking mechanism, when such a blocking mechanism is used, as is the case in the boots of the documents EP 629 793 and IT 19700/83.

In the example of the boot of the document FR 1 568 397, the problem of friction and the tensile force to be produced, as mentioned hereinabove, is practically resolved due to a "Bowden" tightening system using a single sheathed cable pulled by a tensioning lever. However, such a system has the disadvantage of requiring the use of numerous rigid parts, whether for fixing the sheath, anchoring the cable, or mounting the tensioning lever on one of the flaps of the upper located in the zone corresponding to the user's lower leg. Moreover, the "Bowden" tightening system taught connects the edges of the upper to be adjusted on the foot only in three points, and therefore does not make it possible to ensure a good distribution of the tightening between the forefoot, instep and lower leg. Furthermore, if it is necessary to free the foot or the lower leg only, this system proves ill-adapted, because it is the entire boot that is loosened. Of course, this disadvantage is also present in the boot of the document IT 19700/83, because the crossed lacing extends continuously from the forefoot to the lower leg.

Finally, a disadvantage common to all the boots and other footwear articles having a crossed lacing that rises up to the lower leg relates to the difficulty of providing room for the foot in the flexion fold zone for its insertion in or removal from the boot. In fact, in these boots, it is practically always necessary to loosen the strands of the lace by hand, at least up to the instep. This disadvantage does not affect the boots with differentiated tightening using two distinct tightening systems between the foot and the lower leg, as taught by the document EP 629 793. Conversely, the fact that the fastener of the strands of the lace is located at the flexion fold, and especially if it is a locking mechanism, poses another disadvantage. Indeed, in this arrangement, the fastener is capable of hindering the bending of the portion of the upper that surrounds the lower leg with respect to that which surrounds the foot.

SUMMARY OF INVENTION

It is an object of the invention to overcome the aforementioned various disadvantages of the boots and other footwear articles, including the inner liners of the so-called "shell" boots, having a lace-tightening device.

To this end, in the high boot according to the invention having a lace-tightening device on its bottom portion that surrounds the foot, the strands of the lace are alternately crossed by means of returns, from one edge to the other of the upper to be adjusted on the foot, from the forefoot up to the instep, and which overlaps a tongue that extends between the edges that are defined by a front opening of the upper and are then directed so as to converge up to a rigid guiding double tunnel oriented in the longitudinal axis of the boot, and with which the tongue is equipped at its top, or upper, portion beyond the flexion fold, the strands extending through the guiding double tunnel before being fastened to one another.

Thus implemented, the lace-tightening device no longer has crossed lace strands at the flexion fold, and because the strands are converging, then guided in the double tunnel along the longitudinal axis of the boot, they are presented in a direction that coincides with that of the pulling action which the user undertakes on their free ends before fastening them.

In order not to cause the deformation of the top portion of the tongue when tightening the strands, the latter are passed lengthwise through two semi-flexible and non-deformable tubular sheaths that are each inserted, on one of the edges of the upper to be adjusted, between the last return located at the instep and the guiding double tunnel against which they take support. These sheaths thus make it possible to stretch the strands in the same manner as a "Bowden" tightening system, and make it possible to maintain the tongue in an upright position from which one can have very easy access to the strands of the lace.

According to one construction mode, the guiding double tunnel, the tongue, and the semi-flexible sheaths are proportioned toward the top such that the free ends of the strands of the lace extend beyond the top portion of the upper that is adapted to hold the lower leg.

This top portion of the upper can advantageously be made integral or unitary with the bottom portion of the upper that surrounds the foot, but can also be attached on the latter given that, in the two examples of construction mentioned, a tightening device, in addition to that which acts on the foot, is then implemented specifically to hold the lower leg. This device for tightening the lower leg acts on the top portion of the upper by overlapping the tongue that is provided with the semi-flexible sheaths and the double tunnel. In view of the fact that the tubular semi-flexible sheaths are practically non-deformable in the direction of their cross-section, this arrangement does not hinder and has no influence on the tightening of the foot. Indeed, the strands of the lace remain free within the sheaths. As a result, it is possible to voluntarily loosen the foot without modifying the tightening of the lower leg and vice versa.

According to certain advantageous details of construction, the tongue is connected to the edges of the upper to be brought closer together, to adjust the latter on the foot, via at least one sealing arrangement such as a flexible membrane or a sealing gusset, and the tongue is provided with at least one comfort element adapted to distribute, over a larger surface, the pressure exerted on it by the strands of the lace. This comfort element is, for example, a relatively rigid or semi-flexible plate that is attached on the tongue and/or a padding element made, for example, of microcellular material.

A preferred construction includes the provision of a foot-tightening assembly such as defined hereinabove, but mounted on flexible wings extending from a U-shaped piece, and which are then attached on the bottom portion of the boot upper which is then made with a front top opening exposing the top of the foot and adapted to these flexible wings. These wings are proportioned so as to cover at least the top of the foot, and even its flanks partially, so that their coming close together by means of the lace-tightening device, which acts on the returns that are directly connected to the edges of the upper to be adjusted, properly adapts the fitting volume to that of the user's foot. In fact, these flexible wings serve as a mounting support for the tightening assembly and contribute to the sealing of the boot. In this example of the invention, the sealing arrangement of the tongue can be connected to these flexible wings rather than the edges of the upper.

To further facilitate the tightening and fastening of the strands of the lace upon exiting from the double tunnel, a locking mechanism adapted to the spacing of the double tunnel is slipped on the two free strands, and the ends of the latter are connected to one another via a maneuvering handle.

BRIEF DESCRIPTION OF DRAWINGS

The invention will be better understood from the description that follows, with reference to the annexed drawings showing, by way of example, an embodiment applied to a high boot, and in which.

DETAILED DESCRIPTION OF THE INVENTION

Figure 1:
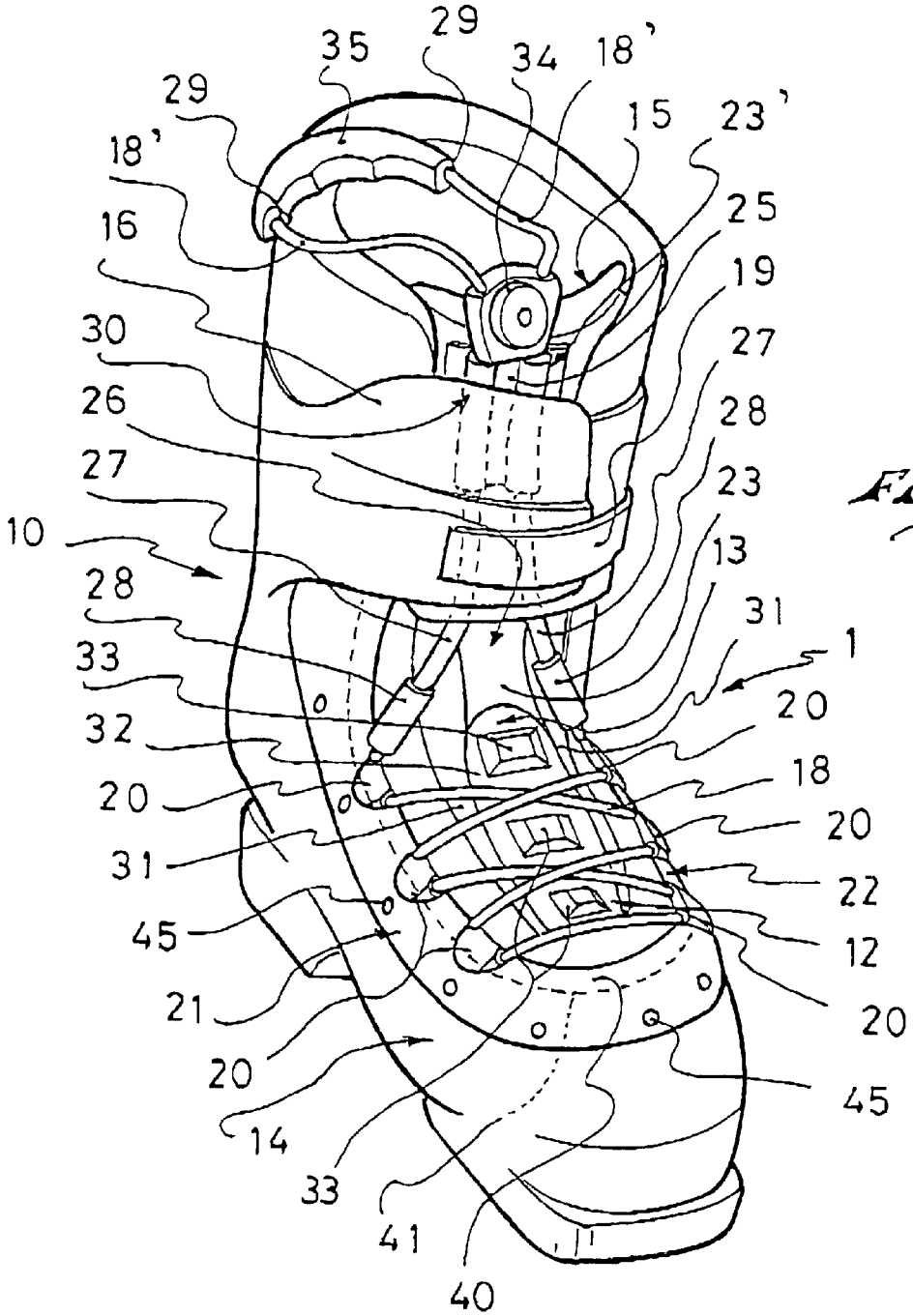
FIGS. 1 and 2 show a perspective view of the high boot including the lace-tightening system according to the invention, the boot upper being open at the lower leg in FIG. 1 and closed in FIG. 2.
Figure 2:
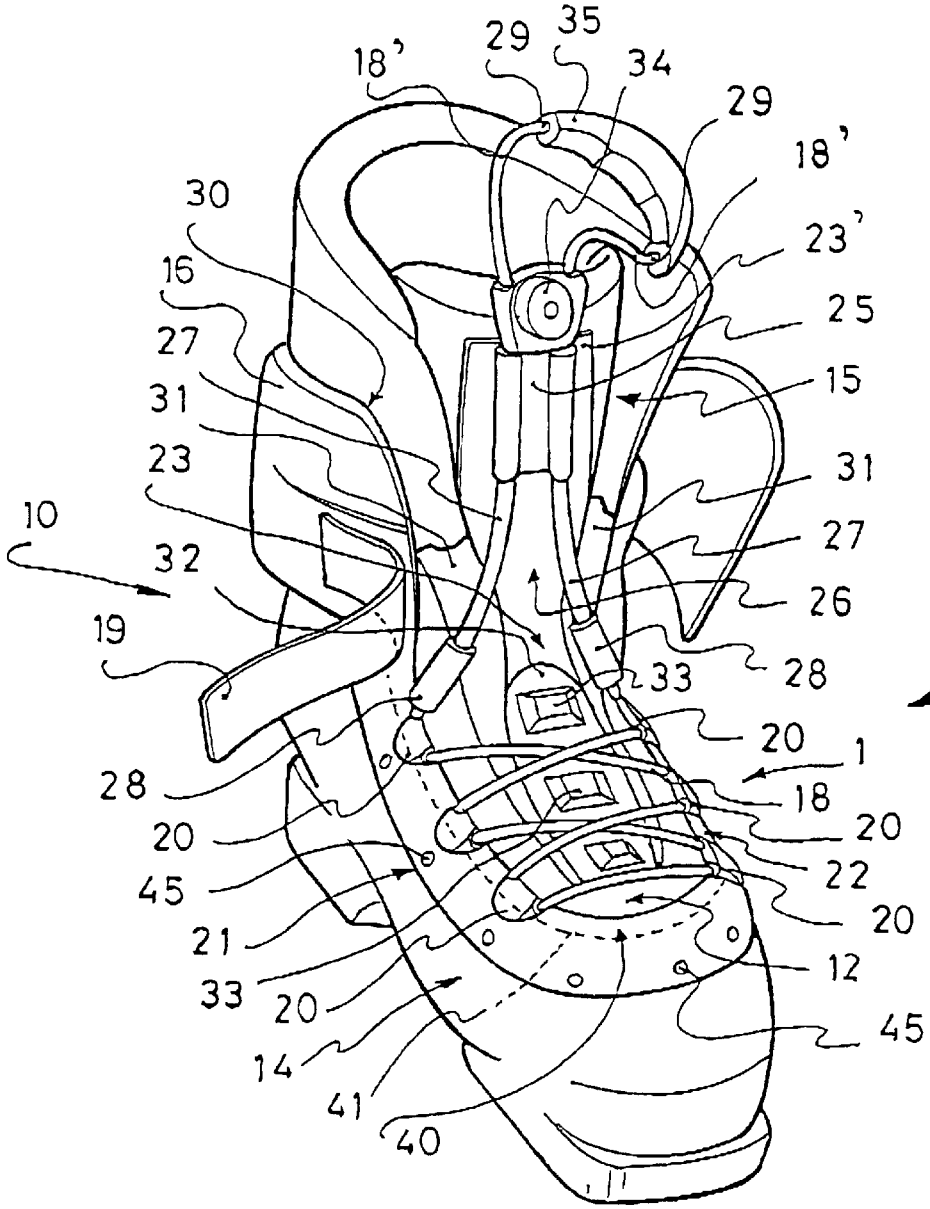

The boot shown in FIGS. 1 and 2 has an upper 10 whose bottom, or lower, portion 14 surrounds the foot, and whose top, or upper, portion 16 surrounds the lower leg 15. This boot closes on the foot, and more specifically from the zone corresponding to the forefoot 12 up to the zone of the instep 13 by means of a tightening device 1 having a lace 18, and on the lower leg 15 by means of a distinct tightening device 19.

According to a particularly important characteristic, the two strands 18' of the lace 18 are alternately crossed up to the instep 13 by means of returns, or return or guide elements, 20, from one edge 21 to the other edge 22 of the upper 10, and overlap a central tongue 23 oriented substantially along the longitudinal axis, or longitudinal vertical median plane, of the boot. The strands 18' are then directed so as to converge beyond the instep 13 and the flexion fold 26, i.e., the forwardly facing flexing area of the boot, toward the top portion 23' of the tongue 23, up to a lacing guide 25, in the form of a guiding double tunnel through which they extend. This guiding double tunnel 25 is approximately centered on the tongue 23 and is also oriented along the longitudinal axis of the boot. In this way, the path of the strands 18' of the lace 18 generally forms an inverted V from the instep 13 which leaves the flexion fold zone 26 completely free. A tightening arrangement such as a strap, for example, can be used so as to overlap this flexion fold zone 26 and over the strands 18' of the lace 18 to ensure, if necessary, a powerful return of the heel of the user's foot in the bottom portion 14 of the upper 10 that nests the heel.

Complementary to this inverted V mounting of the strands 18' of the lace 18, two tubular and semi-flexible sheaths 27, non-deformable in the direction of their length, are each inserted between the last return 20 located at the instep 13 and the guiding double tunnel 25 against which they take support. In this example of construction shown, the sheaths 27 are in fact blocked, toward the last return 20 located at the instep 13, on a bush 28 fixed on the bottom portion 14 of the upper 10. The tightening device 1 with a lace 18 thus constructed functions like a "Bowden" tightening system, since the pulling on the ends 29 of the strands 18' upon exit from the guiding double tunnel 25 has no effect on the entire sheathed path of the lace 18 that extends above the instep 13.

Furthermore, still due to the protection procured by the sheaths 27 in which the strands 18' of the lace 18 slide freely, the tightening and/or loosening of the top portion 16 of the upper 10 of the boot has no influence on the tightening device 1. The latter can be especially loosened and/or tightened independently of the tension state of the tightening device 19 which ensures the holding of the lower leg 15.

Moreover, because of the semi-flexibility of the sheaths 27, the tongue 23 is constantly kept in an upright position that makes it very easy to grip the ends 29 of the strands 18' of the lace 18. The tongue 23, the sheaths 27 and the guiding double tunnel 25 are very advantageously proportioned toward the top, so that the ends 29 of the strands 18' of the lace 18 extend beyond the edge 30 of the top portion 16 of the upper 10.

To ensure proper sealing, the tongue 23 is connected to the transversely opposed edges 21 and 22 of the upper 10, which are contiguous thereto via a flexible membrane 31. According to an advantageous construction, a comfort element 32, constituted by an elongated flexible plate, is attached on the tongue 23 and extends on the latter from the forefoot 12 to the instep 13. In this way, the pressure exerted on the tongue 23 by the strands 18' of the lace 18 is distributed over the surface of the comfort element 32 instead of being localized in the area of and along the strands 18'.

Complementarily, bosses 33 are provided on the comfort element 32 and are spaced from one another, in correspondence with the returns 20. Thus, the strands 18' of the lace 18 cross one another between the bosses 33 which, due to their height, protect them against external impacts or attacks, such as shocks from running edges, for example, and minimize the erosive action of the snow on the lace 18.

An interesting solution for fastening the strands 18' of the lace 18 upon exit from the guiding double tunnel 25 consists of using, as a fastening mechanism 34, i.e., a locking mechanism that is adapted to the spacing of the double tunnel 25 and, additionally, of connecting the ends 29 of the strands 18' to one another via a maneuvering piece 35 such as a handle. The pulling maneuver on the strands 18' is thus much facilitated, and the blocking of the lace 18 under tension occurs without loss of length.

Alternatively, a different fastening mechanism 34, such as a tensioning lever or wedging elements of the lace can also be used.

Figure 3:
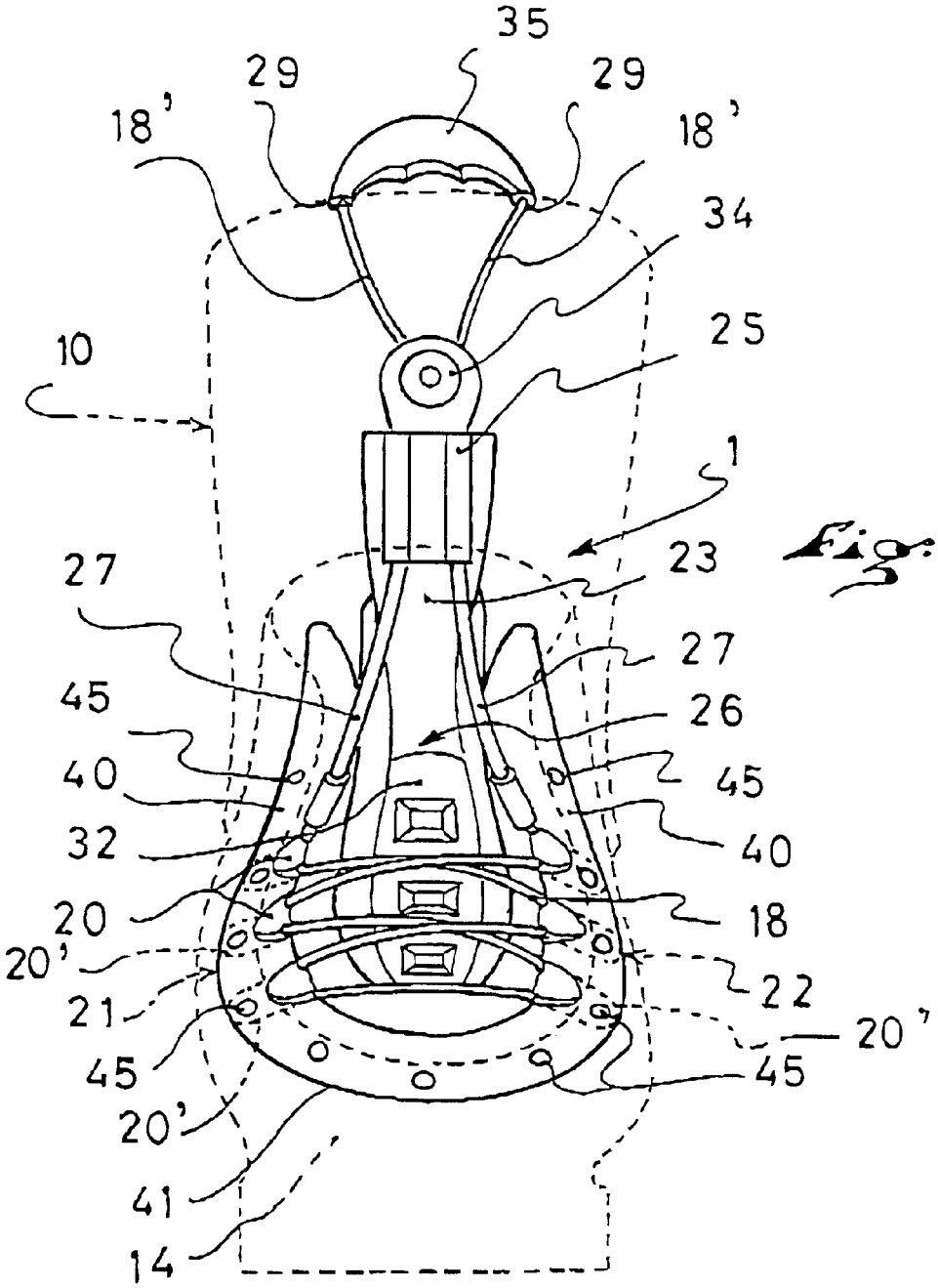
FIG. 3 shows a lace-tightening assembly that is ready to be attached on the bottom portion of the upper of the boot of FIGS. 1 and 2.

According to a particularly advantageous mode of construction that is more apparent in FIG. 3, the tightening device 1 with a lace 18 is a part of an assembly, including flexible legs, or wings, 40 of a U-shaped piece, which is attached and fixed on the bottom portion 14 of the upper 10 of the boot, the bottom of the U-shaped piece being attached to a front part of the upper 10. This assembly therefore includes all of the elements that participate in the function of tightening the foot, namely:

the tongue 23;

the sheaths 27 with the bushes 28 and the double tunnel 25;

the fastening means 34 of the lace 18 and the maneuvering handle 35;

the lace 18 and the returns 20;

the sealing member 31; and the flexible wings 40 which then serve as a substitute, at least partially, for the edges 21 and 22 of the upper 10.

The bottom portion 14 of the upper 10 is then made with a front opening 41, more widely scalloped than for the tongue 23, which exposes the top of the foot. The tightening assembly thus composed is fixed on the bottom portion 14 of the upper 10, by elements 45 such as rivets or bolts, welding, adhesion, etc.

Preferably, these elements 45 also serve to fix the returns 20 directly on the edges 21 and 22 of the upper 10 that are to be adjusted on the foot. To this end, the returns 20 can be made with a fixing lug 20' that is long, more or less, as a function of the desired tightening effect and/or as a function of the dimensions of the flexible wings 40. In this way, the tightening force exerted on the tightening device 1 is always recovered essentially on the edges 21 and 22.

According to an alternative embodiment, the returns 20 can be mounted and fixed on the U-shaped piece defining the flexible wings 40.

Still according to another mode of construction not shown, the boot is provided with an inner liner that is equipped with the tightening device 1 with a lace 18 and the tongue 23. In this example of construction, the top portion 16 of the upper 10 of the boot keeps a tightening device 19 separate from the tightening device 1 with a lace 18. Conversely, the two strands 18' of the lace 18 are alternately crossed on the foot by means of returns 20 that are fixed on the edges of the liner opening, on both sides of the tongue 23. In view of the relative flexibility of the liner, the guiding double tunnel 25 is then preferably extended downwardly up to the flexion fold zone 26, and the tubular semi-flexible sheaths 27 are not used. The shell of the boot thus designed can be provided with flaps and/or a closure arrangement that overlaps the central opening of the liner, from the forefoot 12 to the instep 13.

The instant application is based upon the French Patent Application No. 99 16846, filed Dec. 28, 1999, the disclosure of which is hereby incorporated by reference thereto in its entirety, and the priority of which is hereby claimed under 35 U.S.C. §119.

What is claimed is:

1. A boot comprising:

an upper including a lower portion adapted to receive a foot of a wearer and an upper portion adapted to receive a lower leg of the wearer, said lower and upper portions of said upper of the boot being at least partially demarcated by a forwardly facing flexing area, said lower portion of said upper further including an opening defined at least in part by a pair of transversely opposed edges, and a tongue extending between said transversely opposed edges;

a tightening device to tighten said bottom portion of said upper upon the foot of the wearer, said tightening device comprising:

a plurality of lacing guide elements mounted on said bottom portion of said upper on transversely opposed sides of said opening, all of said lacing guide elements of said tightening device being located forward of said flexing area;

a lacing to adjust a tightening of said bottom portion of said upper on the foot of a wearer, said lacing comprising strands alternately crossing said opening from a first of said transversely opposed edges to a second of said transversely opposed edges, said strands being guided by said plurality of lacing guide elements;

a rigid lacing guide mounted on said tongue above said flexing area of said upper;

said strands converging from a rearwardmost pair of transversely opposed lacing guide elements to said rigid lacing guide; and a tightening device to tighten said upper portion of said upper upon the lower leg of the wearer.

2. A boot according to claim 1, wherein:

said tightening device for said bottom portion of said upper comprising means for tightening said upper from a forefoot area rearwardly only to an instep area of the boot.

3. A boot according to claim 1, wherein:

said rigid lacing guide comprises a rigid double tunnel, said rigid double tunnel including a separate, generally longitudinally extending tunnel for each of a pair of said strands of said lacing.

4. A boot according to claim 1, wherein:

said tightening device for said bottom portion of said upper further comprises two semi-flexible and non-deformable tubular sheaths, said two sheaths being positioned between respective ones of said rearwardmost pair of transversely opposed lacing guide elements and said rigid lacing guide; and each of a pair of said strands of said lacing extends lengthwise through a respective one of said sheaths.

5. A boot according to claim 4, wherein:

said bottom portion of said upper further comprises a U-shaped piece, said U-shaped piece having a bottom part connected to a front part of said upper and a pair of flexible legs extending rearwardly along respective ones of said pair of transversely opposed edges; and said tongue, said sheaths, said rigid lacing guide, and said lacing guide elements for said strands of said lacing are mounted to said flexible wings.

6. A boot according to claim 5, wherein:

said lacing guide elements are fixed upon said flexible legs of said U-shaped piece.

7. A boot according to claim 1, wherein:

said lacing guide elements are directly fixed onto said edges of said upper.

8. A boot according to claim 1, wherein:

said strands extend upwardly beyond said rigid lacing guide, thereby constituting rearward portions of said strands;

said tightening device for said bottom portion of said upper further comprises a locking mechanism to lock said rearward portions of said strands of said lacing.

9. A boot according to claim 8, wherein:

said tightening device for said bottom portion of said upper further comprises a maneuvering handle, said rearward portions of said strands of said lacing being connected to said maneuvering handle.

10. A high boot comprising:

an upper including a bottom portion adapted to surround a foot of a wearer and an upper portion adapted to hold a lower leg of the wearer, said bottom portion including a pair of transversely opposed edges on either side of a front opening, and a tongue extending between said transversely opposed edges;

a lacing-tightening device for said bottom portion of said upper, said lacing-tightening device comprising:

a plurality of return elements mounted along respective ones of said transversely opposed edges from a forefoot to an instep of said bottom portion of said upper, said plurality of return elements including a rearwardmost pair of transversely opposed return elements of said lacing-tightening device, said rearwardmost pair of transversely opposed return elements being positioned, no farther rearward than said instep;

a lacing to adjust a tightening of said bottom portion of said upper on the foot of a wearer, said lacing comprising strands alternately crossing said opening from a first of said transversely opposed edges to a second of said transversely opposed edges, said strands being guided by said plurality of return elements and being positioned above said tongue;

a generally longitudinally extending rigid lacing tunnel mounted on a top portion of said tongue above a flexion fold of said upper;

said strands extending from said rearwardmost pair of transversely opposed return elements to said rigid lacing tunnel along a converging path;

said strands extending upwardly beyond said rigid lacing tunnel and upwardly beyond said upper portion of said upper.

11. A boot according to claim 10, wherein:

said upper portion of said upper is unitary with said bottom portion of said upper; and said boot further comprises a tightening device for tightening said upper portion of said upper upon the lower leg of the wearer, said tightening device for said upper portion of said upper overlapping said tongue.

12. A boot according to claim 10, wherein:

said upper portion of said upper is attached to said bottom portion of said upper; and said boot further comprises a tightening device for tightening said upper portion of said upper upon the lower leg of the wearer, said tightening device for said upper portion of said upper overlapping said tongue.

13. A boot according to claim 10, wherein:

said tongue is connected to said pair of transversely opposed edges of said upper via of a sealing arrangement.

14. A boot according to claim 10, wherein:

said tongue is provided with at least one comfort element adapted to distribute, over a larger surface, pressure exerted by said strands of said lacing.

15. A boot according to claim 10, wherein:

said rigid lacing tunnel comprises a rigid double tunnel, said rigid double tunnel including a separate, generally longitudinally extending tunnel for each of a pair of said strands of said lacing.

16. A boot according to claim 10, wherein:

said lacing-tightening device for said bottom portion of said upper further comprises two semi-flexible and non-deformable tubular sheaths, said two sheaths being positioned between respective ones of said rearwardmost pair of transversely opposed return elements and said rigid lacing tunnel; and each of a pair of said strands of said lacing extends lengthwise through a respective one of said sheaths.

17. A boot according to claim 16, wherein:

said bottom portion of said upper further comprises a U-shaped piece, said U-shaped piece having a bottom part connected to a front part of said upper and a pair of flexible legs extending rearwardly along respective ones of said pair of transversely opposed edges; and said tongue, said sheaths, said rigid lacing tunnel, and said return elements for said strands of said lacing are mounted to said flexible wings.

18. A boot according to claim 17, wherein:

said return elements are fixed upon said flexible legs of said U-shaped piece.

19. A boot according to claim 10, wherein:

said return elements are directly fixed onto said edges of said upper.

20. A boot according to claim 10, wherein:

said strands extend upwardly beyond said rigid lacing tunnel, thereby constituting rearward portions of said strands;

said lacing-tightening device for said bottom portion of said upper further comprises a locking mechanism to lock said rearward portions of said strands of said lacing.

21. A boot according to claim 20, wherein:

said lacing-tightening device for said bottom portion of said upper further comprises a maneuvering handle, said rearward portions of said strands of said lacing being connected to said maneuvering handle.

* * * * *